US007043038B2

(12) United States Patent
Bächler et al.

(10) Patent No.: US 7,043,038 B2
(45) Date of Patent: May 9, 2006

(54) IN-THE-EAR HEARING DEVICE

(75) Inventors: Herbert Bächler, Meilen (CH); Jörg Mayer, Niederlenz (CH); Hans Hessel, Benglen (CH); Erdal Karamuk, Zürich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 10/202,182

(22) Filed: Jul. 24, 2002

(65) Prior Publication Data

US 2004/0017922 A1 Jan. 29, 2004

(51) Int. Cl.
*H04R 25/00* (2006.01)

(52) U.S. Cl. ..... 381/322; 381/324; 381/328

(58) Field of Classification Search ..... 381/322–328, 381/359; 181/129–130, 135
See application file for complete search history.

(56) References Cited

U.S. PATENT DOCUMENTS

| | | | | |
|---|---|---|---|---|
| 4,815,138 | A * | 3/1989 | Diethelm | |
| 5,401,920 | A * | 3/1995 | Oliveira | |
| 5,455,994 | A | 10/1995 | Termeer et al. | |
| 5,530,763 | A * | 6/1996 | Aebi et al. | 381/322 |
| 5,701,348 | A | 12/1997 | Shennib et al. | |
| 5,821,468 | A | 10/1998 | Urella et al. | |
| 2002/0025055 | A1 * | 2/2002 | Stonikas et al. | 381/322 |

FOREIGN PATENT DOCUMENTS

JP WO 99/09788 * 2/1999

* cited by examiner

*Primary Examiner*—Suhan Ni
(74) *Attorney, Agent, or Firm*—Pearne & Gordon LLP

(57) ABSTRACT

An in-the-ear hearing device comprises an outside body, which is at least in part of textile material (3). The textile material allows to optimally adapt shape and shape dynamics as well as biocompatibility to the respective characteristics of an individual ear canal.

15 Claims, 3 Drawing Sheets

IN-THE-EAR HEARING DEVICE

Figure 1:
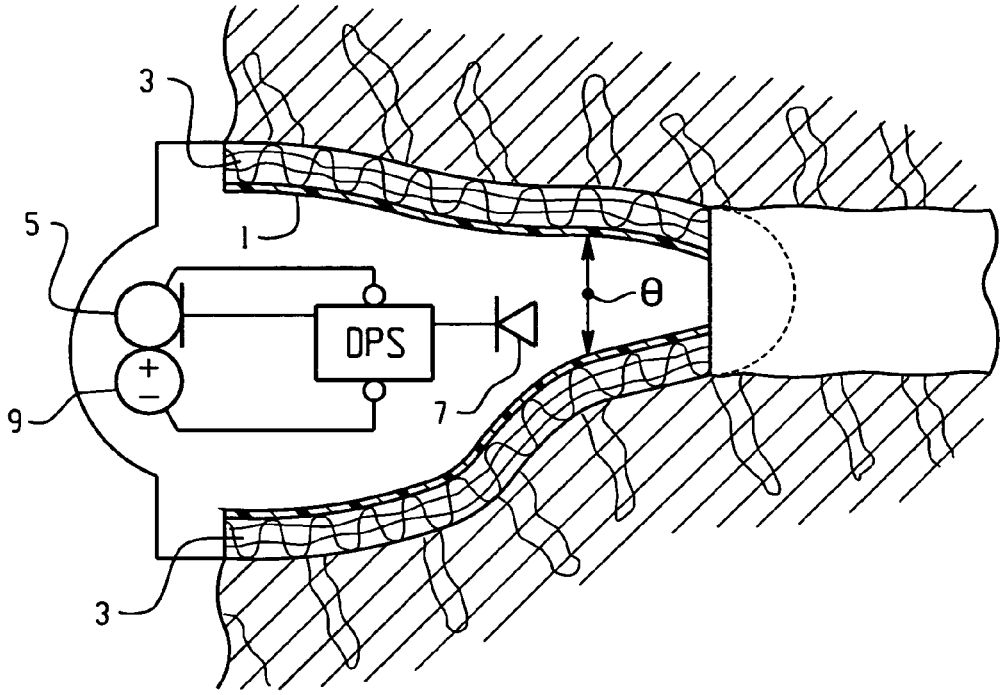

The present invention is directed on an in-the-ear hearing device which comprises at least one functional module and has a first surface pointing towards the outside, enclosing said at least one functional module.

DEFINITION

We understand throughout the present description and the claims under the term "functional module" a module which influences the characteristics between acoustical input signals and psycho-acoustical reception by an individual who carries the in-the-ear hearing device. Thereby, such a module will most often comprise multiple sub-modules as an electrical/mechanical output transducer and an electronic unit which controls such output transducer. Further, acoustical signals may impinge on an acoustical/electrical input transducer, which latter may be a sub-module of the functional module within the in-the-ear hearing device or may be situated remote therefrom, e.g. as a wireless microphone. In latter case the acoustical signals transformed to electrical signals by such an input transducer are transmitted, either by a wire connection or by a wireless connection to the hearing device.

Customarily in-the-ear hearing devices are today manufactured with a hard or flexible material shell, wherein the functional module resides. This in spite of the fact that the shape of individual's ear canal changes dynamically, as during chewing, laughing etc. and in spite of the fact that the shape of ear canals greatly vary from individual to individual. Further, the ear canal does not have an overall equal compliance, but has some areas, which are more cartilaginous or bony than others. One of the most severe problems with in-the-ear hearing devices is the misscomfort, which individuals experience when carrying such devices. In spite of the fact that considerable efforts have been made to remedy this problem, no satisfying solution has been found yet. For instances some approaches propose soft in-the-ear device shells, so e.g. of silicon. Such solutions were not satisfying predominantly due to the long-term instability of such shell materials as with respect to changing color, becoming harder, considerable contamination by dust, cerumen, sweat etc. and difficult cleaning, which raised the risk of ear canal irritations and infections. Additionally, carrying comfort was not optimal, i.e. the individual still sensed a pressure on the ear canal. The known approaches to resolve the above mentioned problem may be subdivided into two categories. According to the first category the functional module is built into a shell of resilient material.

According to the second category the functional module is built into a rigid material shell, which is embedded into a resilient, mostly replaceable covering.

According to the U.S. Pat. No. 4,962,537 the outer shape of an in-the-ear hearing device is formed by a hardened otoplastic material, which surrounds a pliable member and filling the volume between the pliable member and the wall of the ear canal. Within the pliable member the functional module is provided. The otoplastic material may consist of two mixed components chemically cured or may be cured by a light-curing process if the material contains a photo initiator.

Thereby, such in-the-ear hearing device may not accomplish high requirements with respect to comfort due to its outer shape being formed from completely hardened otoplastic material.

According to the WO 60/70911 the functional modules are molded into soft elastomeric material.

According to the WO 99/55259 the functional module of an in-the-ear hearing device comprises an outer shell, which is formed from a material selected from the group consisting of soft thermoplastics, thermoplastic elastomers, thermoplastic rubber and any combination thereof.

According to the WO 99/31935 the functional module is embedded into an elastomer shell. According to the WO 99/31934 the functional module is encapsulated or embedded within a soft material. The material may be silicon or silicon polymer.

From the U.S. Pat. No. 5,654,530 there is known to provide around a standard shell with the functional module seal and retainer elements in form of annular, disk-shaped collars. They are preferably composed of elastic plastic, e.g. of silicon or of an elastomer.

According to the EP-A-0 451 784 there is provided, for an in-the-ear hearing device, a standardized housing, which contains the functional module, Upon such housing there is provided a shell which can be custom-molded of either a compliant or of a rigid material. By means of the shell the standardized housing is adapted to be carried either in the right or in the left ear.

According to the WO 87/07465 a mass production in-the-ear hearing device comprises a hollow rigid core containing the functional module. Applied to the outside of said core is a soft resilient covering of one of a plurality of pre-affixed shapes and thicknesses.

According to the WO 93/25053 an in-the-ear hearing device comprises a hollow rigid core construction, which contains the functional module. An ear shell formed of soft polymer encloses the core.

A main problem of known soft outer shell materials for in-the-ear hearing devices is the multitude of requirements to the soft material and some tradeoffs thereof. This may be the reason why none of the described and known solutions has been properly established in practice. The requirements to such soft shell materials are:

Degree of stiffness or respectively compliancy. This characteristic of outer shell material determines with which pressure the hearing device will reside on the inner wall of the ear canal, thereby taking the dynamics of such canal into account, e.g. during speaking, laughing, chewing etc. The compliancy of the ear canal wall itself is substantially varying along its extent and may even be time-varying during dynamic movement of the ear canal. Therefore, a soft outer shell should have compliancy characteristics, which take such local and time-varying characteristics of the ear canal's wall into account, should e.g. have a very low compliancy or stiffness at parts, which are to reside on parts of the ear canal, which are rather bony, and should be stiffer at other parts, which are to be located nearer to the entrance of the ear canal, where cartilaginous structure prevails.

It is known, as was mentioned, that the shape of the ear canal is time-varying as during speaking, chewing etc. The material of an outer shell should be able to follow such movement dynamics, thereby not increasing its pressure onto the ear canal wall. If elasticity of the outer shell material is insufficient or has some kind of memory or hysteresis behavior, the result is that uncontrolled air spaces will arise between the outer surface of the shell and the inner surface of the ear canal, which may significantly influence the acoustical characteristic and transmission behavior of the in-the-ear hearing device in an uncontrolled and unpredictable manner.

Additionally, one must take into account that the volume of the ear canal together with its varying shape also varies. Thus, the outer shell material should be compressible, so as to deal with the dynamic volume of the ear canal by changeability of its proper volume. E.g. silicon is rather incompressible.

Further the material of the outer shell may not be acoustically transparent and should, considered over the length extent of the in-the-ear hearing device, provide for an acoustical dampening of up to 80 dB, so as to prevent negative acoustical feedback.

Further, the material of the outer shell must be biocompatible.

It must further be resistant chemically as with respect to sweat and cerumen. Some of the soft and elastic polymers show a high affinity for lipids, which penetrate from cerumen into the polymer matrix and affect the mechanical properties of such polymer material. Further, the outer shell material should be resistant to cleaning and antiseptic detergents, if such outer shell is intended to be cleaned and is not construed as a one-use, throw-away article.

On the other hand if such shell is conceived to be frequently replaced, then it must be a mass-production article, which may be construed at lowest costs.

Thus, it is an object of the present invention to provide for an in-the-ear hearing device, which fulfills the above mentioned complex combination of requirements.

This is realized by means of the in-the-ear hearing device, which comprises at least one functional module and has a first surface pointing towards the outside and at least substantially enclosing the at least one functional module, and whereat at least a part of said first surface is covered with a textile material defining for an outer second surface pointing towards the outside.

DEFINITION

We understand throughout the present description and claims as a "textile material" a material which comprises fibers of any extent and material, which are not materially bonded to each others. Such a textile material may e.g. be non-woven material as fleece material, or woven material, The respective fibers may thereby be synthetic and/or natural.

It is known from the WO 99/09788 to provide clip-on hearing aids or more generically outside-the-ear hearing aid bodies with a low-cost knit-fabric protective cover which protects such device from dust, sweat without impeding the device's proper functions. Unlike the in-the-ear hearing device of the present invention, the knit-fabric protective cover, which is applied like a sock over the outside-the-ear hearing device, does not provide for any adaptation of the outer form of the device to a restricted area of insertion as represented by an ear canal.

According to the present invention the device may be designed according to the above mentioned category 1, with a flexible shell at least in part covered by the textile material or may directly enclose the functional module, so that the first surface as mentioned is directly formed by said modules. Such module forms a rigid material standard-shape shell.

Although the textile material covering may be integral with the ear device shell or even with the at least one functional module forming a standard shape shell, and as being e.g. glued to the shell or directly to the at least one functional module, it is preferred to have the textile material replaceable and exchangeable. Further, the textile material may be covered itself by an outer thin layer as of a foil-like layer and/or with a further textile material, thereby forming a sandwich multi-layer structure. Thus, the textile material may be just one layer of a two- or more than two layer structure.

In a further preferred embodiment the textile material has a thickness elasticity so as to snugly adapt to the shape and dynamic deformation of an individual's ear canal. In a further preferred embodiment the textile material forms a carrier for at least one substance, which is adapted to interact with an individual carrying said device. Thereby, and in a still further embodiment, such substance is a medicamentation substance as e.g. an antiseptic substance. Such a substance may be provided to penetrate the skin of individual's ear canal surface and to interact with the individual remote from the ear canal. It may be e.g. a medicine for long-term effect, diffusing through individual's skin and holding the individual under prescribed medication.

Further, in a preferred embodiment, such medical substance is provided to treat directly ear canal diseases. In a further preferred embodiment the textile material forms a sock-shaped body, which is open at at least one of its ends and which is snugly applied over the first surface being the shell of an in-the-ear hearing device as of a standard shape or already adapted to the shape of an individual's ear canal, or be it directly upon the at least one functional module surface. The textile material comprises as was mentioned at least one of synthetic material and of natural material fibers. The textile material may e.g. be formed from synthetic material adjacent to the first surface, whereas to the outside it is formed from natural material fibers, so that only latter are brought into direct intimate contact with the inside of individual's ear canal.

In a further embodiment more than one textile material is provided, being one upon the other or being one aside the other for taking into account different needs at different areas of the hearing device.

A further object of the present invention is to provide for a novel method for cleaning in-the-ear devices. Such method comprises surrounding at least one functional module of an in-the-ear hearing device by a removable body with a textile material and replacing such body for cleaning. The textile body removed may either be thrown away or may be cleaned e.g. in a specific cleaning solution.

A further object of the present invention is to provide a novel method for applying a substance to an individual's body. Such method comprises providing at an in-the-ear hearing device a hollow body with textile material, providing a substance to the textile material, applying said substance to the body by applying the device with the body to the ear of an individual to be treated by such substance.

It is a further object of the present invention to provide for a novel method for adapting an in-the-ear device to individual's shape of ear canal. This method comprises the step of providing at the outside of a shell—standard-shaped or already adapted to the shape of individual's ear canal—a body of textile material and conceiving thickness elasticity of the body to snugly adapt shape to the shape of the ear canal of an individual.

Figure 2:
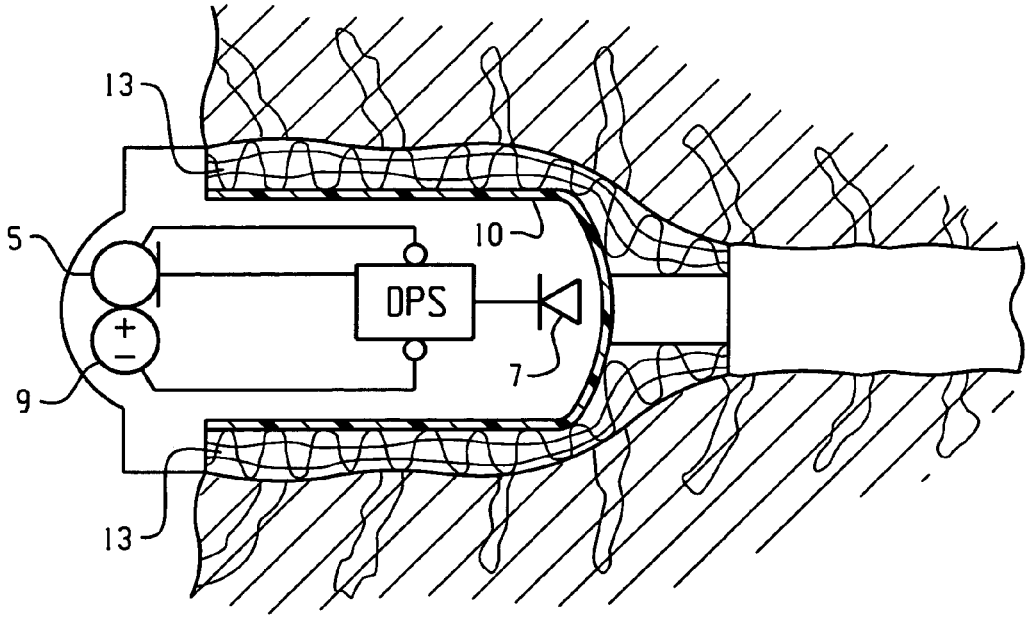
Figure 3A:
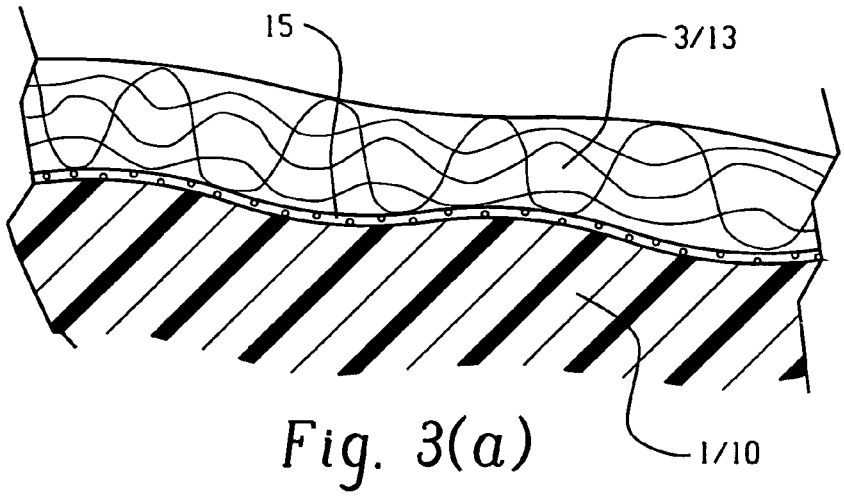
Figure 3B:
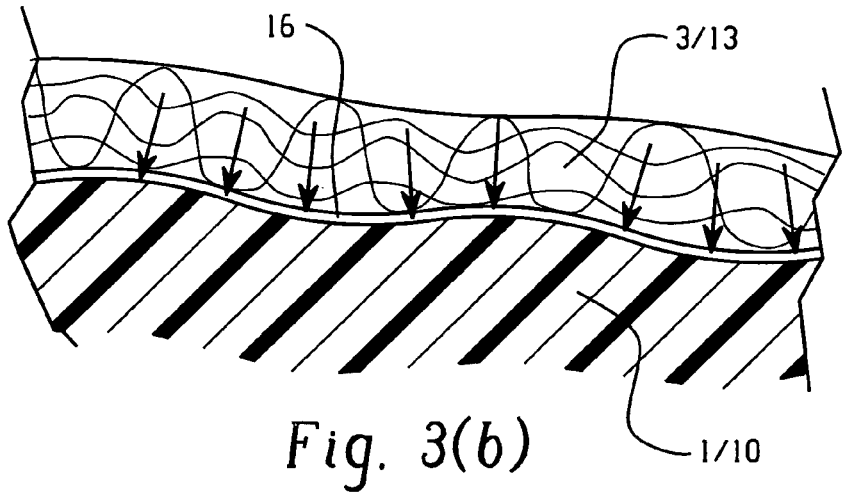
Figure 3C:
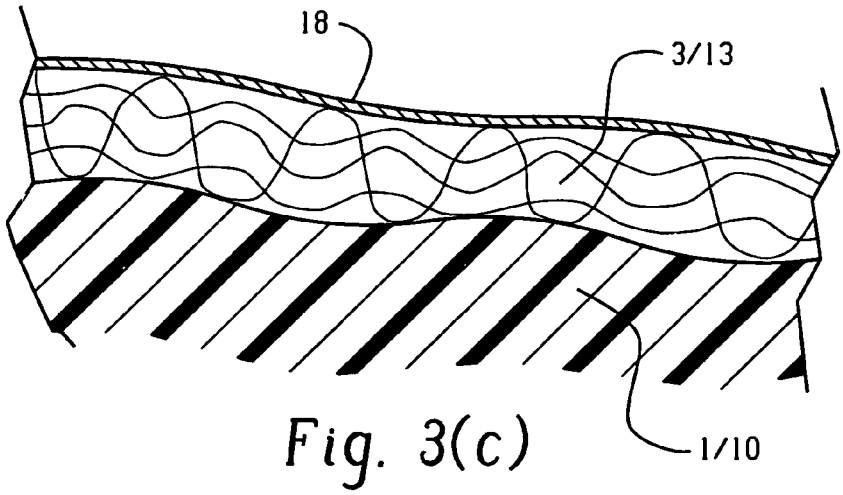
Figure 3D:
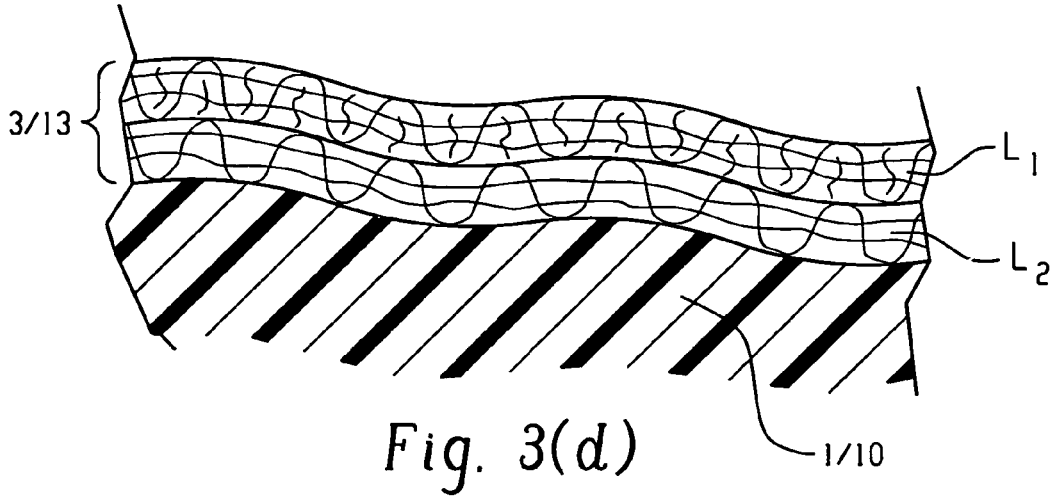
Figure 3E:
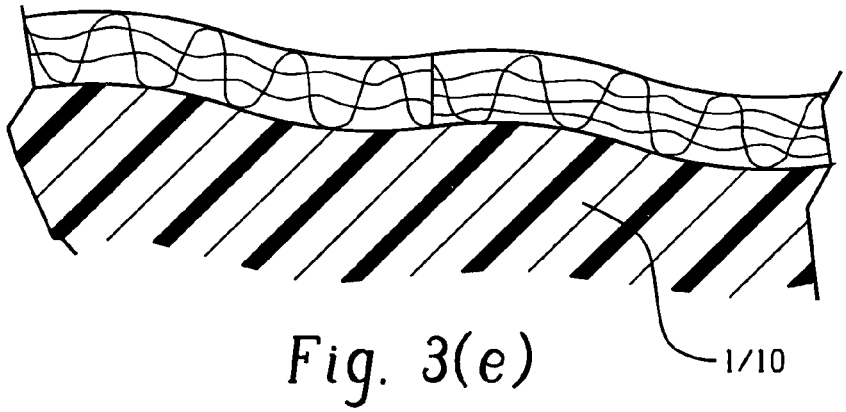
Figure 4:
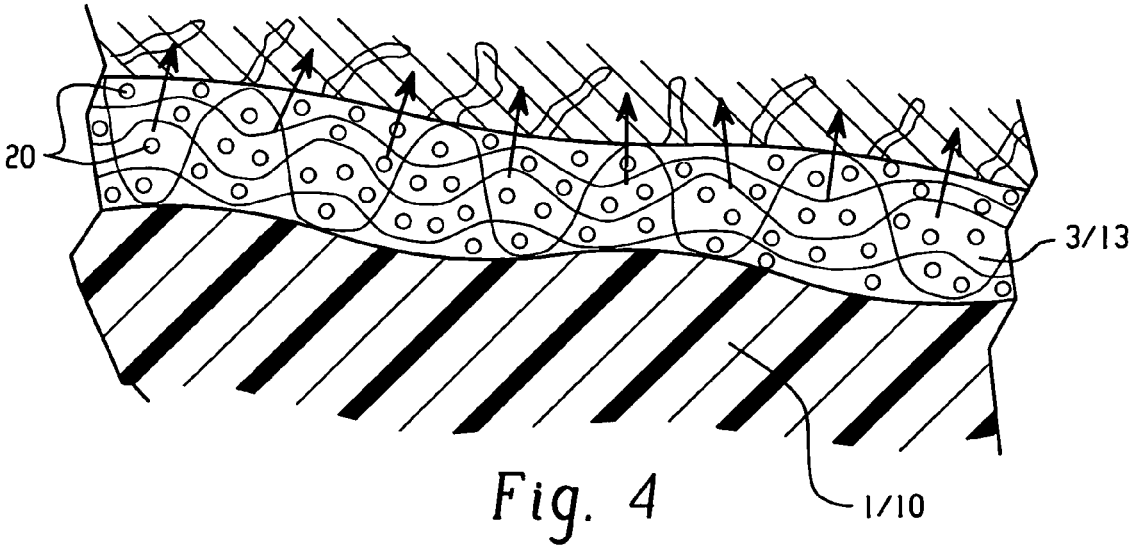

The invention will now be described with the help of figures and with respect to different exemplifying embodiments. The figures show:

FIG. 1 schematically an in-the-ear hearing device according to the present invention and conceived of a customized reduced-volume shell with a textile material covering;

FIG. 2 in a schematic representation in analogy to that of FIG. 1 an in-the-ear hearing device according to the present invention conceived of a standardized shell functional module with a textile covering;

FIGS. 3(*a*) to (*e*) apart of an inventive hearing aid device with different-structured textile material covering;

FIG. 4 in a representation according to those of FIG. 3 a part of an inventive in-the-ear hearing device with textile material covering and with a substance contained therein diffusing into the tissue of the individual.

According to FIG. 1 a hearing device according to the present invention comprises a conventionally manufactured shell 1. Such shell 1 is shaped according to the individual ear canal shape, but with reduced volume and respective diameters ϕ.

The shell 1 may be manufactured of rigid or elastic material as e.g. by three-dimensionally imaging individual's ear canal, storing the imaging data and shaping the shell as by laser lithography, laser sintering etc., as described in the WO 01/05207. The shell may also be manufactured by first taking a mold of the ear canal, scanning the resulting shape of the mold, reducing the shape of the scanned mold by computation and controlling shell manufacturing by the reduced-shape data, to take into account space for the textile material to be provided as will be described.

Nevertheless, it is not of extreme importance to manufacture the shell 1 with an outer shape, which exactly matches the shape of the ear canal or even takes the dynamics of the shape of the ear canal into account. This because according to the present invention at least a part of the surface of the shell 1, preferably the entire outer surface thereof provided as a first surface, is covered with a body of or at least comprising a textile material layer 3. This textile material of the body snugly adapts to the individual's ear canal shape and to any dynamic of such canal's shape. The textile material layer 3 may thereby be of uniform material and material structure, as of density, or may be conceived with locally varying characteristics as with locally varying density and thus porosity, locally varying elasticity and compliancy etc. to fully meet the requirements with respect to optimum fit of the hearing device to individual's ear canal shape and its dynamics. Thereby, and as will be shown later the body with the textile material layer preferably snugly resides on shell 1, but is removable therefrom. For cleaning or more generically for replacing on any reasons, it may be drawn from shell 1 and replaced by a new body with textile material layer being equal or different so as to take into account e.g. any variations, which meanwhile have occurred at the shape and dynamics of the ear canal or of its skin characteristics.

As shown in FIG. 1, shell 1 is freely exposed towards the ear drum. Nevertheless and depending on the acoustical transmittance behavior of the textile material selected, generically for the overall textile material layer or its part at the end of the shell, the end area of the hearing device may be covered too by textile material as shown in FIG. 1 with dashed lines.

As further schematically shown in FIG. 1 inside the shell 1 and as customary there is provided possibly an input acoustical to electrical transducer 5 operationally connected to a signal evaluation unit, e.g. a digital processing unit DPS, which on its turn is operationally connected to the output electrical to mechanical converter 7, as to a speaker. Further, a power supply unit 9, as a battery or accumulator, resides within shell 1.

With today's scanning technique it is possible to directly three-dimensionally scan or imagine the individual's ear canal or to scan a mold of the individual's ear canal and to reduce its shape to provide for space to accommodate the inventively provided textile material as shown in FIG. 1.

According to FIG. 2 the in-the-ear hearing device according to the present invention comprises a standard functional module 10, which is manufactured of standard shape for a great variety of ear canal dimensions, so e.g. one type for adults and one type for children. Thereby the standardized functional module 10 is small enough to be loosely introduced in the said great variety of individual's ear canal shapes. Within the shell of this standard functional module, which normally will be substantially rigid, there is provided e.g. the input acoustical to electrical converter 5, if provided at all, the electronic unit as the DPS unit and the output electrical/mechanical converter 7 besides of the power supply 9.

Proper fitting with respect to comfort, adaptation to the structure and dynamics of the ear canal wall of an individual is performed by providing preferably all around the standard functional module 10 a body with textile material 13, which is thick enough, compliant enough to fully adapt to the individual shape of the ear canal and to its individual dynamics. As again shown in dashed lines the functional module 10 and especially the mechanical or acoustical output thereof may be freely exposed towards the ear drum or may be covered with textile material too.

With respect to homogeneous or inhomogeneous characteristics along and throughout the textile material they are selected according to the characteristics of the ear canal. The textile material forms preferably part of a hollow body.

Again, in a preferred embodiment the textile material body is easily replaceable to take into account any needs for changing characteristics of the textile material body for an individual or of replacing, after some time, as after several days, an abused and/or contaminated textile material body by a new one.

In FIGS. 3(*a*) to (*e*) some examples of possible structuring of the textile material body or layer as was explained with the help of FIG. 1 or 2 are shown. Through all the examples 3(*a*) to (*e*) there is shown a part of shell 1 or functional module 10 as of the FIGS. 1 and 2 respectively. Upon the surface of such shell 1 or functional module 10 and according to FIG. 3(*a*) the textile material body or layer 3 according to FIG. 1 or layer 13 according to FIG. 2 is rigidly mounted, as by having such body 3/13 applied to the surface of the shell 1 or functional module 10 by gluing as shown at 15. Nevertheless, and as we emphasized in context with FIGS. 1 and 2, it is preferred to have the textile material layer or body 3/13 easily removable from the surface of shell 1 or functional module 10 without any mechanical bond thereto, besides of an elastic fit.

According to FIG. 3(*b*) this is schematically shown by showing a free gap 16 between the body 3/13 and the surface of member 1/10, whereat the textile material body just snugly and elastically presses on the surface of member 1/10, as shown and schematisized by the pressure arrows.

Irrespective whether textile material body 3/13 is bonded to the surface of member 1/10 according to FIG. 3(*a*) or elastically resides thereon according to FIG. 3(*b*), the outer surface of textile material body 3/13 may be covered as shown in FIG. 3(*c*) by a layer 18, which may be foil-like, e.g. of a material specifically adapted to the skin of the ear canal, or which may be a layer of densified material of the textile material body 3/13, so as to prevent or slow down penetration of sweat and cerumen into the lower-density core of the body 3/13, where it may lead to some hardening and reduction of the body compliancy and elasticity.

As further shown in FIG. 3(*d*) the textile material body 3/13 consists of more than one layer, at least one of them being of textile material. In the specific embodiment of FIG. 3(*d*) it comprises two layers $L_1$ and $L_2$ of different characteristics textile material. $L_2$ takes e.g. into account the necessity of firm elastic residing on the surface of the member 1/10, whereas the outer layer $L_1$ of textile material too takes into account all the requirements with respect to individual ear canal. Thus, the textile material body 3/13 comprises at least one textile material-layer, but other one or more than one layers may be provided which consist of additional textile materials, of different characteristics or which may comprise non-textile layers too. The textile material body or layer 3/13 may therefore be conceived in a sandwich multi-layer concept.

Whereas the concept exemplified by FIG. 3(*d*) shows the possibility of different characteristic layers one upon the other, the example of FIG. 3(*e*) shows the possibility of providing such different characteristic materials one besides of the other, i.e. along the surface of member 1/10. By applying as shown in that FIG.4 textile materials of different characteristics one besides the other or even by applying textile materials and non-textile material layers one besides the other and along the surface of member 1/13, a further possibility is created to optimally adapt the overall characteristics of the layer ox body to the needs with respect to individual's ear canal characteristics.

In FIG. 4 there is again schematically shown a part 1/10 of shell 1 as of FIG. 1 or of functional module 10 as of FIG. 2, whereupon layer or body with a textile material 3/13 is applied. Within the textile material 3/13 there is provided a substance 20, as a medication substance, an antiseptic substance, which slowly diffuses, as schematically shown, into the tissue of individual's ear canal. The textile material represents a reservoir e.g. for long-term medication of the individual as especially for ear canal diseases, infections etc.

By the inventively applied textile material it becomes possible adapt mechanical and chemical properties of the outer surface area of an in-the-ear hearing device by appropriately selecting fiber material, orientation, extent and density, to optimally fit with respect to comfort and compatibility with the individual ear canal.

The invention claimed is:

1. In-the-ear hearing device comprising at least one functional module and an outer first surface at least substantially enclosing said at least one functional module, at least a part of said first surface being covered with a conformable textile material defining an outer second surface, wherein said textile material has a thickness and thickness elasticity so as to snugly adapt the shape of the device to the individualized shape and dynamic deformation of an individual's ear canal.

2. The hearing device of claim 1, wherein said first surface is formed by an ear device shell containing said at least one functional module.

3. The device of claim 2, wherein said textile material is integral with said ear device shell.

4. The device of claim 1, wherein said first surface is formed by said at least one functional module itself.

5. The device of claim 1, wherein said textile material is replaceable.

6. The device of claim 1, wherein said textile material forms one layer of an at least two-layer structure.

7. The device of claim 1, wherein said textile material forms a carrier for at least one substance adapted to interact with an individual carrying said device.

8. The device of claim 7, wherein said substance is a medicamentation substance.

9. The device of claim 8, wherein said medicamentation substance is provided to penetrate the skin of individual's ear canal surface and to interact with said individual remote from said ear canal.

10. The device of claim 8, wherein said medicamentation substance is provided to treat ear canal disease.

11. The device of claim 1, wherein said textile material is part of a hollow body being open at at least one of its ends and being applied over said first surface.

12. The device of claim 1, wherein said textile material comprises at least one of synthetic material and of natural material fibers.

13. The device of claim 1, wherein more than one textile materials are provided upon said first surface.

14. A method for adapting an in-the-ear device with an outer surface to an individual's ear canal shape comprising the steps of providing a body with conformable textile material to the outside surface of said device and providing said textile material with a thickness elasticity to snugly adapt the shape of the body to the individualized shape of the individual's ear canal.

15. The method of claim 14 further comprising the step of:

applying a substance to an individual's body comprising the steps of:

providing a diffusable substance to said textile material; and, applying said diffusable substance to said individual's body by inserting said device with said textile material and said diffusable substance thereon in an ear of said individual.

* * * * *

UNITED STATES PATENT AND TRADEMARK OFFICE

CERTIFICATE OF CORRECTION

PATENT NO. : 7,043,038 B2
APPLICATION NO. : 10/202182
DATED : May 9, 2006
INVENTOR(S) : Bächler et al.

It is certified that error appears in the above-identified patent and that said Letters Patent is hereby corrected as shown below:

In Column 5, line 5, please delete “apart” and insert --a part--

Signed and Sealed this

Fourteenth Day of November, 2006

JON W. DUDAS
*Director of the United States Patent and Trademark Office*